US007352985B2

(12) United States Patent
Tomizawa

(10) Patent No.: US 7,352,985 B2
(45) Date of Patent: Apr. 1, 2008

(54) IMAGE FORMING APPARATUS CAPABLE OF SUPPRESSING DETERIORATION OF IMAGE WHEN TONER IMAGE ON IMAGE BEARING MEMBER IS TRANSFERRED TO INTERMEDIATE TRANSFER MEMBER

(75) Inventor: Takeshi Tomizawa, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 331 days.

(21) Appl. No.: 11/250,380

(22) Filed: Oct. 17, 2005

(65) Prior Publication Data

US 2006/0083558 A1 Apr. 20, 2006

(30) Foreign Application Priority Data

Oct. 20, 2004 (JP) ..... 2004-306260

(51) Int. Cl.
*G03G 15/20* (2006.01)

(52) U.S. Cl. ..... 399/302; 399/162; 399/308

(58) Field of Classification Search ..... 399/159, 399/162, 297, 302, 308
See application file for complete search history.

(56) References Cited

U.S. PATENT DOCUMENTS 6,920,299 B2 * 7/2005 Shimura et al. ..... 399/121
7,264,911 B2 * 9/2007 Matsumura et al. ..... 399/252

FOREIGN PATENT DOCUMENTS

| | | |
|---|---|---|
| JP | 63-311263 | 12/1988 |
| JP | 1-97146 | 4/1989 |
| JP | 5-200904 | 8/1993 |
| JP | 6-149081 | 5/1994 |
| JP | 11-15294 | 1/1999 |
| JP | 11-212374 | 8/1999 |
| JP | 2000-47495 | 2/2000 |
| JP | 2001-235946 | 8/2001 |
| JP | 2004-198788 | 7/2004 |
| JP | 2006-146187 | * 6/2006 |

* cited by examiner

*Primary Examiner*—Hoan Tran
(74) *Attorney, Agent, or Firm*—Fitzpatrick, Cella, Harper & Scinto

(57) ABSTRACT

An image forming apparatus having: an image bearing member, which bears an electrostatic image thereon; a developing device, which develops the electrostatic image with toner to form a toner image, and an intermediate transfer member, which is in contact with the image bearing member and to which the toner image formed on the image bearing member is transferred, wherein the surface microhardness of the intermediate transfer member is smaller than the surface microhardness of the toner, and the adhesive force index of Kawakita method of the toner is 110 or greater.

6 Claims, 14 Drawing Sheets

IMAGE FORMING APPARATUS CAPABLE OF SUPPRESSING DETERIORATION OF IMAGE WHEN TONER IMAGE ON IMAGE BEARING MEMBER IS TRANSFERRED TO INTERMEDIATE TRANSFER MEMBER

BACKGROUND OF THE INVENTION

1. Field of the Invention

The invention relates to an image forming apparatus using an intermediate transfer member contacting with an image bearing member, and particularly to an image forming apparatus which can improve the quality of a toner image transferred from an image bearing member to an intermediate transfer member.

2. Related Background Art

In an image forming apparatus using an intermediate transfer member, a toner image is formed on an image bearing member such as a photosensitive drum. Then, this toner image is once primary-transferred to an intermediate transfer member in a primary transfer portion. Thereafter, the toner image on the intermediate transfer member is secondary-transferred from the intermediate transfer member onto a recording material such as paper in a secondary transfer portion.

A resin material is widely used as a material forming the intermediate transfer member. As specific examples thereof, polyvinylidene fluoride (PVdF) is described in Japanese Patent Application Laid-open No. H5-200904, polycarbonate (PC) is described in Japanese Patent Application Laid-open No. H6-149081, and polyimide is described in Japanese Patent Application Laid-open No. S63-311263.

The resin materials are excellent in mechanical characteristic. On the other hand, however, an intermediate transfer member formed of a resin material is small in the amount of deformation when it is brought into pressure contact with an image bearing member. That is, the amount of deformation of the intermediate transfer member in a primary transfer portion is small. Thus, in the primary transfer portion, great pressure acts on a toner from the intermediate transfer member.

Further, pressure from intermediate transfer concentrates in a portion of the intermediate transfer member on which the amount of toner is locally great when the toner is transferred from the image bearing member to the intermediate transfer member.

Thereupon, the toner image on the portion in which the pressure concentrates is crushed. For example, when the toner image is a line-shaped image, there arises the problem that the line width on the image bearing member is widened by the toner image being transferred to the intermediate transfer member.

In order to solve this problem, Japanese Patent Application Laid-open No. H10-97146 proposes an intermediate transfer member provided with an elastic layer. When an elastic layer is provided on the intermediate transfer member, the hardness of the intermediate transfer member becomes smaller than the hardness of the toner. Thereupon, even if as described above, there exists a portion in which the amount of toner is locally great, the intermediate transfer member is deformed along the toner and therefore, the concentration of the pressure in the portion wherein the amount of toner is great is alleviated. Accordingly, the crushing of the toner image by the concentration of the pressure is suppressed.

However, if the intermediate transfer member having the elastic layer is used, there will arise the problem that when the toner image is transferred from the image bearing member to the intermediate transfer member, there occurs the so-called "scattering" that toner particles scatter around the toner image transferred to the intermediate transfer member.

FIGS. 7A, 7B, 7C and 7D of the accompanying drawings show the mechanism of the occurrence of the scattering.

FIG. 7A represents the toner "t" of a toner image present on an image bearing member (photosensitive drum) 1.

As shown in FIG. 7B, when the toner "t" is transferred from the image bearing member 1 to an intermediate transfer member 51, the intermediate transfer member provided with an elastic layer is deformed along the toner "t". By the intermediate transfer member 51 being deformed, even if there exists a portion on which the amount of toner is locally great in the toner image on the photosensitive drum 1, the concentration of pressure in this portion on which the amount of toner is great is suppressed.

Here, pressure is substantially uniformly applied from the intermediate transfer member 51 to the toner image on the image bearing member 1. Thereupon, the toner image on the image bearing member 1 is transferred to the intermediate transfer member 51 while substantially maintaining its shape.

FIG. 7C is a typical view of the toner image transferred to the intermediate transfer member 51.

As shown in FIG. 7C, the toner "t" in the upper layer portion of the toner image transferred to the intermediate transfer member 51 becomes unstable. That is, as shown in FIG. 7C, the toner "t" in the upper layer portion becomes liable to move in the direction indicated by the arrow. Thereupon, as shown in FIG. 7D, the scattering occurs.

SUMMARY OF THE INVENTION

It is an object of the present invention to suppress, in an image forming apparatus using an intermediate transfer member of which the surface microhardness is smaller than that of a toner "t" occurrence of scattering when a toner image on an image bearing member is transferred to the intermediate transfer member.

It is also an object of the present invention to provide an image forming apparatus having:

an image bearing member bearing an electrostatic image thereon;

developing means for developing the electrostatic image with a toner to thereby form a toner image; and an intermediate transfer member, which is in contact with the image bearing member and to which the toner image formed on the image bearing member is transferred;

wherein the surface microhardness of the intermediate transfer member is smaller than the surface microhardness of the toner, and the adhesive force index of Kawakita method of the toner is 110 or greater.

It is another object of the present invention to provide an image forming method having:

the step of forming an electrostatic image on an image bearing member;

the step of developing the electrostatic image with a toner to thereby form a toner image; and the step of transferring the toner image to an intermediate transfer member being in contact with the image bearing member;

wherein the surface microhardness of the intermediate transfer member is smaller than the surface microhardness of the toner, and the adhesive force index of Kawakita method of the toner is 110 or greater.

DESCRIPTION OF THE PREFERRED EMBODIMENTS

Figure 7A:
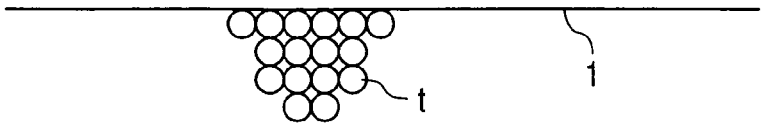
FIGS. 7A, 7B, 7C and 7D illustrate the behavior of the toner in a primary transfer portion when the intermediate transfer member is soft.
Figure 7B:
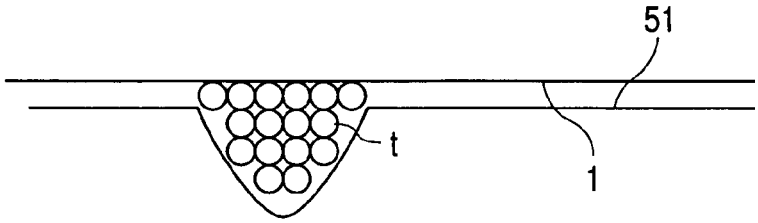
Figure 7C:
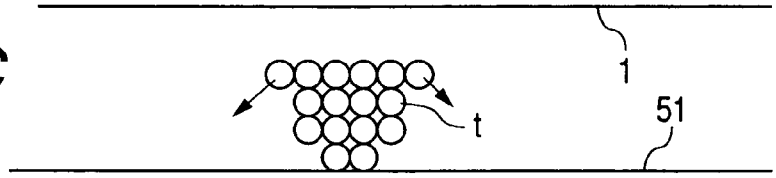
Figure 7D:
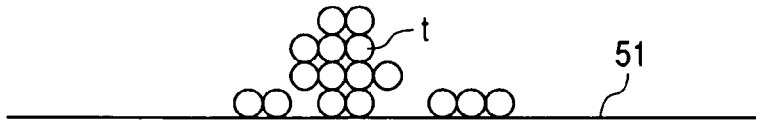

In the present invention, the above-noted problem has been solved by the adhesive force index of Kawakita method of a toner being made 110 or greater. That is, by making toner particles large and making the adhesive force of the toner particles great, it becomes possible to suppress the movement of an upper layer portion in the directions indicated by the arrows in FIGS. 7A, 7B and 7C when a toner image has been transferred onto an intermediate transfer member. In this manner, the occurrence of scattering is suppressed.

Some embodiments of the present invention will hereinafter be described with reference to the drawings. Throughout the drawings, like reference characters designate members similar in construction or action, and the duplicate description of these is suitably omitted.

Embodiment 1

Figure 1:
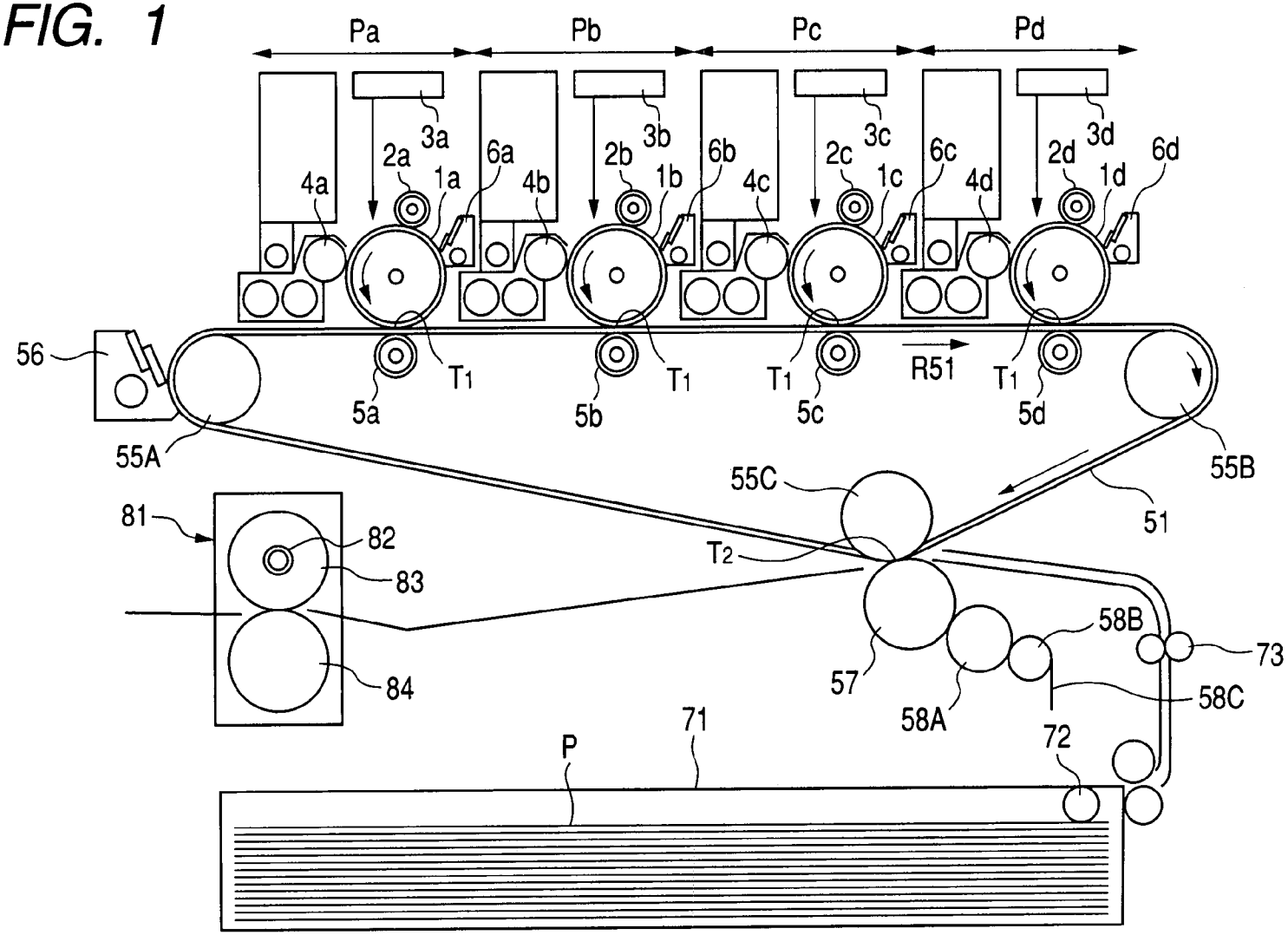
FIG. 1 is a longitudinal cross-sectional view schematically showing the construction of an image forming apparatus to which the present invention can be applied and as it is seen from its front side.

FIG. 1 shows an image forming apparatus to which the present invention can be applied. The image forming apparatus shown in FIG. 1 is a four-color full-color image forming apparatus of a tandem type, an intermediate transfer type and an electrophotographic type, and FIG. 1 is a longitudinal cross-sectional view schematically showing the construction of this image forming apparatus as it is seen from its front side.

The outline of this image forming apparatus will hereinafter be described with reference to FIG. 1.

The image forming apparatus shown in FIG. 1 is provided with four process units Pa, Pb, Pc and Pd, and an intermediate transfer belt (intermediate transfer member) 51 disposed below them. In these process units Pa, Pb, Pc and Pd, yellow (Y), magenta (M), cyan (C) and black (K) toner images are formed on photosensitive drums 1*a*, 1*b*, 1*c* and 1*d*, respectively, by image forming processes such as charging, exposure, developing, transferring and cleaning. These color toner images are successively primary-transferred onto the intermediate transfer belt 51 in respective primary transfer portions T1. The toner images of the four colors thus superposed one upon another on the intermediate transfer belt 51 are secondary-transferred to a recording material S such as paper in a secondary transfer portion T2. The recording material S after the secondary transfer of the toner images has the toner image fixed on its surface by a fixing device. 81. Thereby, image formation on one side of a sheet of recording material S is completed.

The foregoing image forming apparatus will hereinafter be described in detail.

The drum-shaped electrophotographic photosensitive members (photosensitive drums) 1*a*, 1*b*, 1*c* and 1*d* as image bearing members are disposed in the respective process units Pa, Pb, Pc and Pd for forming yellow, magenta, cyan and black color images, respectively. The respective photosensitive drums 1*a*, 1*b*, 1*c* and 1*d* are rotatively driven in the direction indicated by the arrow (counter-clockwise direction) in FIG. 1 by driving means (not shown). Around the respective photosensitive drums 1*a*, 1*b*, 1*c* and 1*d*, there are disposed charging rollers (primary charging devices) 2*a*, 2*b*, 2*c*, 2*d* as charging means, exposing devices 3*a*, 3*b*, 3*c*, 3*d* as exposing means, developing devices 4*a*, 4*b*, 4*c*, 4*d* as developing means, primary transfer rollers (transferring devices) 5*a*, 5*b*, 5*c*, 5*d* as primary transferring means, and cleaning devices 6*a*, 6*b*, 6*c*, 6*d* as cleaning means substantially in the named order along the rotation direction of the photosensitive drums.

Figure 2:
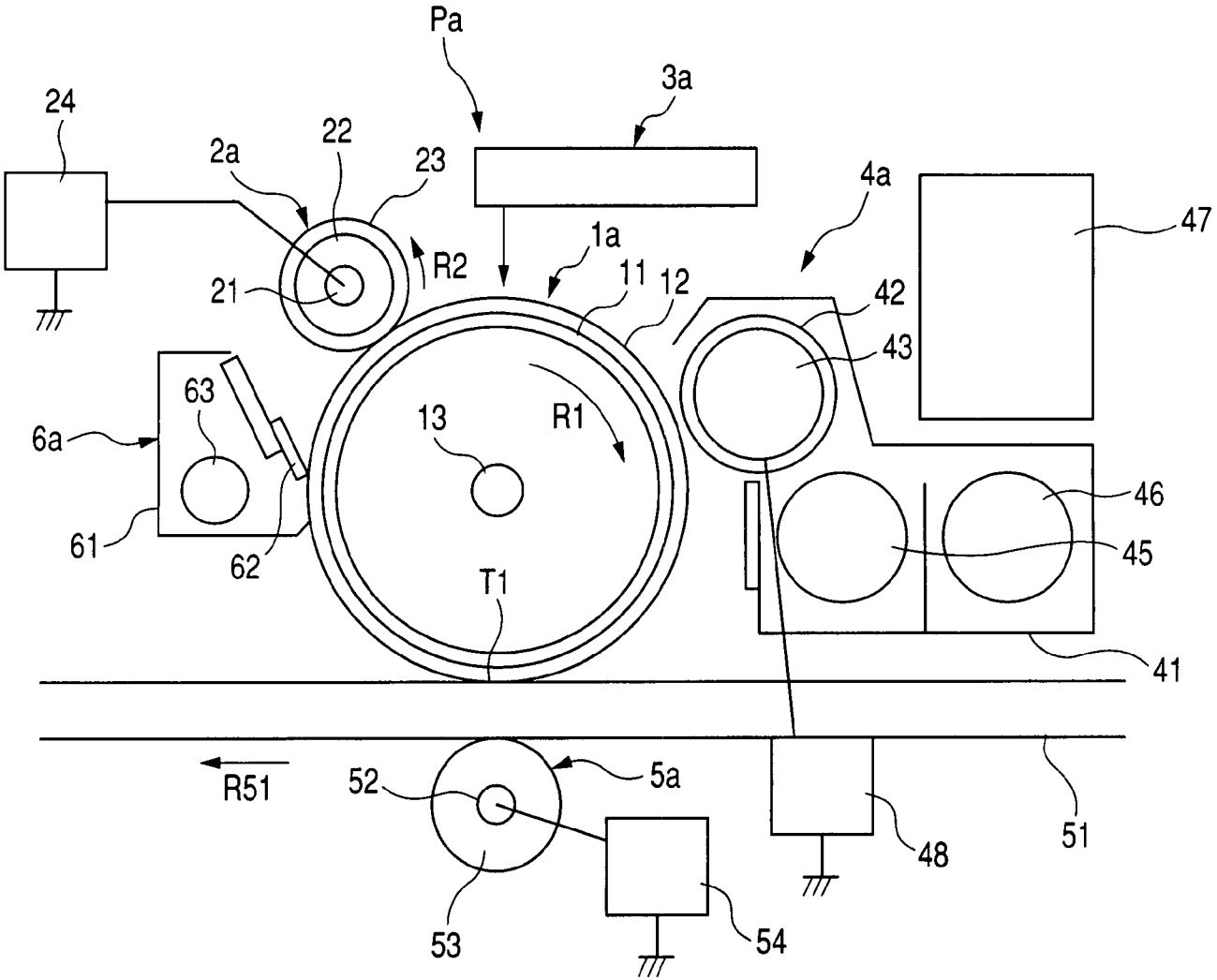
FIG. 2 is an enlarged view of the vicinity of a yellow process unit.

Subsequently, the process units Pa, Pb, Pc and Pd will be described in detail with reference to FIG. 2. These four process units Pa, Pb, Pc and Pd are of the same construction and therefore, in the following, the yellow process unit Pa will be described and the other process units Pb, Pc and Pd need not be described.

The process unit Pa is provided with the drum-shaped electrophotographic photosensitive member (photosensitive drum) 1*a* as an image bearing member. The photosensitive drum 1*a* is a cylindrical electrophotographic photosensitive member basically comprising a drum-shaped electrically conductive base 11 of aluminum or the like, and a photoconductive layer 12 formed on the outer periphery thereof. The photosensitive drum 1*a* has a supporting shaft 13 at the center thereof, and is adapted to be rotatively driven in the direction indicated by the arrow R1 about this supporting shaft 13 at a predetermined process speed (peripheral speed) by driving means (not shown).

The primary charging roller 2*a* is disposed above the photosensitive drum 1*a*. The primary charging roller 2*a* is constituted into a roller shape as a whole by an electrically conductive mandrel 21 disposed at the center thereof, and a low-resistance electrically conducting layer 22 and a medium-resistance electrically conducting layer 23 formed on the outer periphery thereof, and is disposed in parallelism to the photosensitive drum 1*a*. The mandrel 21 has its longitudinal opposite end portions rotatably supported by bearing members (not shown). Also, the bearing members are biased toward the photosensitive drum 1*a* by biasing means (not shown) such as compression springs. Thereby, the primary charging roller 2*a* is brought into pressure contact with the surface of the photosensitive drum 1*a* with a predetermined pressure force. By this pressure contact, a band-shaped primary transfer portion T1 is formed between the photosensitive drum 1*a* and the primary transfer roller 2*a*. The primary charging roller 2*a* is driven to rotate in the direction indicated by the arrow R2 by the rotation of the photosensitive drum 1*a* in the direction indicated by the arrow R1. Further, the primary charging roller 2*a* has a charging bias voltage applied thereto by a voltage source 24, to thereby uniformly contact-charge the surface of the photosensitive drum 1*a* to a predetermined polarity and predetermined potential.

The exposing device 3*a* is disposed on the downstream side of the primary charging roller 2*a* along the rotation direction of the photosensitive drum 1*a*. The exposing device 3*a* is constituted, for example, by a laser scanner, which ON/OFF-controls a laser beam on the basis of image information. The charged surface of the photosensitive drum 1*a* is scanned and exposed by the laser beam, and the charges of the exposed portion thereof are eliminated. Thereby, an electrostatic latent image according to the image information is formed on the photosensitive drum 1*a*.

The developing device 4*a* disposed downstream of the exposing device 3*a* has a developer container 41 containing a dual-component developer therein, and a developing sleeve 42 is rotatably disposed in the opening portion of this developer container 41 which faces the photosensitive drum 1*a*. A magnet roller 43 for causing the developer to be carried on the developing sleeve 42 is fixedly disposed in the developing sleeve 42 against rotation relative to the rotation of the developing sleeve 42. Below the developing sleeve 42 in the developer container 41, there is installed a regulating blade 44 for regulating the developer carried on the developing sleeve 42 and forming a thin developer layer. Further, a developing chamber 45 and an agitating chamber 46 comparted from each other are provided in the developer container 41, and above them, there is provided a supplying chamber 47 containing therein a toner to be supplied. The developer made into a thin developer layer on the surface of the developing sleeve 42 is carried to a developing area opposed to the photosensitive drum 1*a* with the rotation of the developing sleeve 42. The developer carried to the developing area is stood like the ears of rice by the magnetic force of the developing main pole of the magnet roller 43 disposed in the developing area, and forms a magnetic brush. This magnetic brush rubs the surface of the photosensitive drum 1*a* and also, a developing bias voltage is applied to the developing sleeve 42 by a voltage source 48, whereby the toner adhering to a carrier constituting the ears of the magnetic brush adheres to the exposed portion of the electrostatic latent image. Thereby, the electrostatic latent image is developed as a toner image.

Below the photosensitive drum 1*a* downstream of the developing device 4*a*, there is disposed the primary transfer roller 5*a* with an intermediate transfer belt 51 interposed therebetween. The primary transfer roller 5*a* is constituted by a mandrel 52 having a bias applied thereto by a voltage source 54, and an electrically conducting layer 53 formed into a cylindrical shape on the outer peripheral surface thereof. The primary transfer roller 5*a* has its longitudinal opposite end portions biased toward the photosensitive drum 1*a* by biasing members (not shown) such as compression springs, whereby the electrically conducting layer 53 of the primary transfer roller 5*a* pushes the intermediate transfer belt 51 with a predetermined pressure force to thereby bring the intermediate transfer belt 51 into pressure contact with the surface of the photosensitive drum 1*a*. Thereby, the primary transfer portion (primary transfer nip portion) T1 is formed between the photosensitive drum 1*a* and the intermediate transfer belt 51. A bias opposite in polarity to the charging polarity of the toner image formed on the photosensitive drum 1*a* is applied to the primary transfer roller 5*a*. Thereby, the toner image on the photosensitive drum 1*a* is primary-transferred to the surface of the intermediate transfer belt 51.

Toner residual on the surface of the photosensitive drum 1*a* (untransferred toner) after the primary transfer of the toner image is removed by the cleaning device 6*a*. The cleaning device 6*a* scrapes off the untransferred toner on the photosensitive drum 1*a* into a cleaning container 61 by a cleaning blade 62 urged against the surface of the photosensitive drum 1*a*. The scraped-off untransferred toner is carried into a waste toner container (not shown) by a carrying screw 63.

The above-described image forming processes, i.e., a series of primary charging, exposing, developing, primary transferring and cleaning processes, are executed also in the other process units Pb, Pc and Pd. Thereby, toner images of the respective colors, i.e., yellow, magenta, cyan and black formed on the photosensitive drums 1*a*, 1*b*, 1*c* and 1*d* of the respective process units Pa, Pb, Pc and Pd are successively primary-transferred onto the intermediate transfer belt 51, and are superposed one upon another on the intermediate transfer belt 51.

The intermediate transfer belt 51 is passed over a driven roller 55A, a drive roller 55B and a secondary transfer opposed roller 55C. The secondary transfer opposed roller 55C nips the intermediate transfer belt 51 between it and a secondary transfer roller 57. The secondary transfer portion (secondary transfer nip portion) T2 is formed between the secondary transfer roller 57 and the intermediate transfer belt 51. The toner images of the four colors superposed one upon another on the intermediate transfer belt 51 in the manner described above are carried to the secondary transfer portion T2 with the rotation of the intermediate transfer belt 51 in the direction indicated by the arrow R51, as shown in FIG. 1.

On the other hand, a recording material P taken out of a sheet supplying cassette 71 by this time is supplied to conveying rollers 73 via a pickup roller 72, is further carried to the left as viewed in FIG. 1, and is supplied to the secondary transfer portion T2. Then, the toner images of the four colors on the intermediate transfer belt 51 are collectively secondary-transferred onto the recording material P by a secondary transfer bias applied to at least one of the secondary transfer opposed roller 55C and the secondary transfer roller 57. In the present embodiment, there is adopted a method of applying a bias of the same polarity as the charging polarity of the toner on the intermediate transfer belt 51 to the mandrel of the secondary transfer opposed roller 55C. The untransferred toner, etc. on the intermediate transfer belt 51 are removed and collected by a transfer belt cleaner 56.

Stains such as the toner adhering to the secondary transfer roller 57 are scraped off by a fur brush 58A of which the contact portion is rotated in a direction opposite to the rotation direction of the secondary transfer roller 57, and are also removed by electrostatic action by a bias applied to this fur brush 58A. A bias roller 58B is brought into contact with this fur brush 58A, and a bias opposite in polarity to the toner is applied to this bias roller 58B to thereby remove the toner adhering to the surface of the secondary transfer roller 57. Further, design is made such that almost all of the toner adhering to this fur brush 58A is collected by the bias roller 58B, and a blade 58C is brought into contact with the surface of this bias roller 58B to thereby remove the toner on the surface of the bias roller 58B.

The recording material P to the surface of which the toner image has been transferred in the secondary transfer portion T2 is conveyed to the fixing device 81, where the toner image is fixed on the surface thereof. The fixing device 81 has a rotatable fixing roller 83 having a heater 82 such as a halogen lamp therein disposed therein, and a pressure roller 84 rotated while being in pressure contact with this fixing roller 83. The fixing device 81 effects the temperature adjustment of its surface by controlling a voltage or the like to the heater 82. In a state in which this temperature adjustment has been effected, the recording material P is pressurized and heated from both of its front and back sides by substantially constant pressure and temperature when it passes between the fixing roller 82 and the pressure roller 83 being rotated at a constant speed, whereby the unfixed toner image on the surface thereof is fused and fixed. Thereby, the formation of a four-color full-color image on one side of the recording material P is completed.

Figure 3:
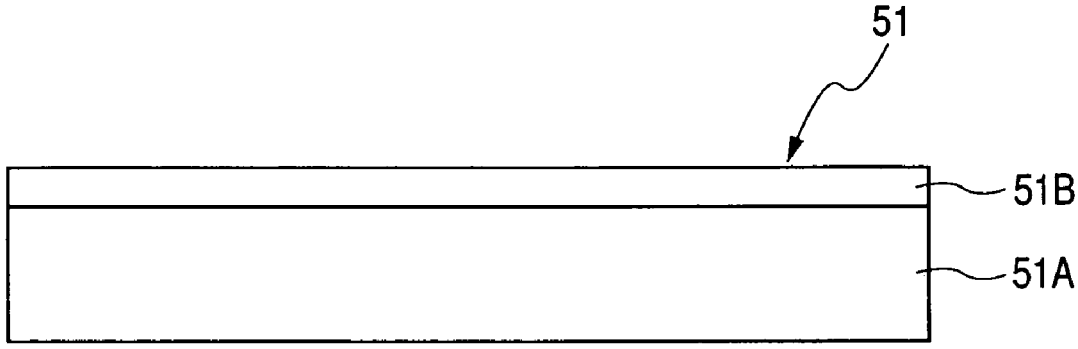
FIG. 3 typically shows the layer construction of an intermediate transfer belt in Embodiment 1.

In the present embodiment, the above-described image forming apparatus uses the intermediate transfer belt 51 as shown in FIG. 3. The intermediate transfer belt 51, as shown in FIG. 3, is constituted by an elastic layer 51A provided on the back side thereof, and a surface layer 51B provided on the front side thereof.

The elastic layer 51A should preferably be formed of such a material softer than synthetic resin as typified by rubber. Also, the film thickness (layer thickness) of the elastic layer 51A should preferably be greater than a maximum toner layer thickness formed on the intermediate transfer belt 51. Further, it should more preferably be twice or more as great as the maximum toner layer thickness formed on the intermediate transfer belt 51. In the present embodiment, the elastic layer 51A adopts semi-electrically conductive chloroprene rubber having JISA hardness of 50 to 70°, a film thickness of 200 to 500 μm, a tensile elasticity modulus of $1\times10^5$-$10^7$ Pa (JIS K 7161), a compressive elasticity modulus of $1\times10^6$-$10^8$ Pa (JIS K 7181) and volume resistivity of $1\times10^8$-$10^{12}$ Ω·cm (a measuring method similar to that described above).

The surface layer 51B should preferably be formed of a material, which is small in surface roughness and good in slidability, and is excellent in toner mold releasability. In the present embodiment, the surface layer 51B was formed with Daiel (trademark) latex GLS-213F produced by Daikin Industries, Ltd. as a water-based paint by spray coating. The surface of the above-described elastic layer 51A was spray-coated with this surface layer 51B, and thereafter was hardened at 150 to 200° C. for 30 minutes to thereby form a surface layer 51B having a thickness of 5 to 20 μm. As the result, the coefficient of static friction of the surface of the surface layer 51B, i.e., the coefficient of static friction of the surface of the intermediate transfer belt 51 was 0.2 to 0.6, and the surface roughness thereof was 1 to 5 μm.

Figure 4:
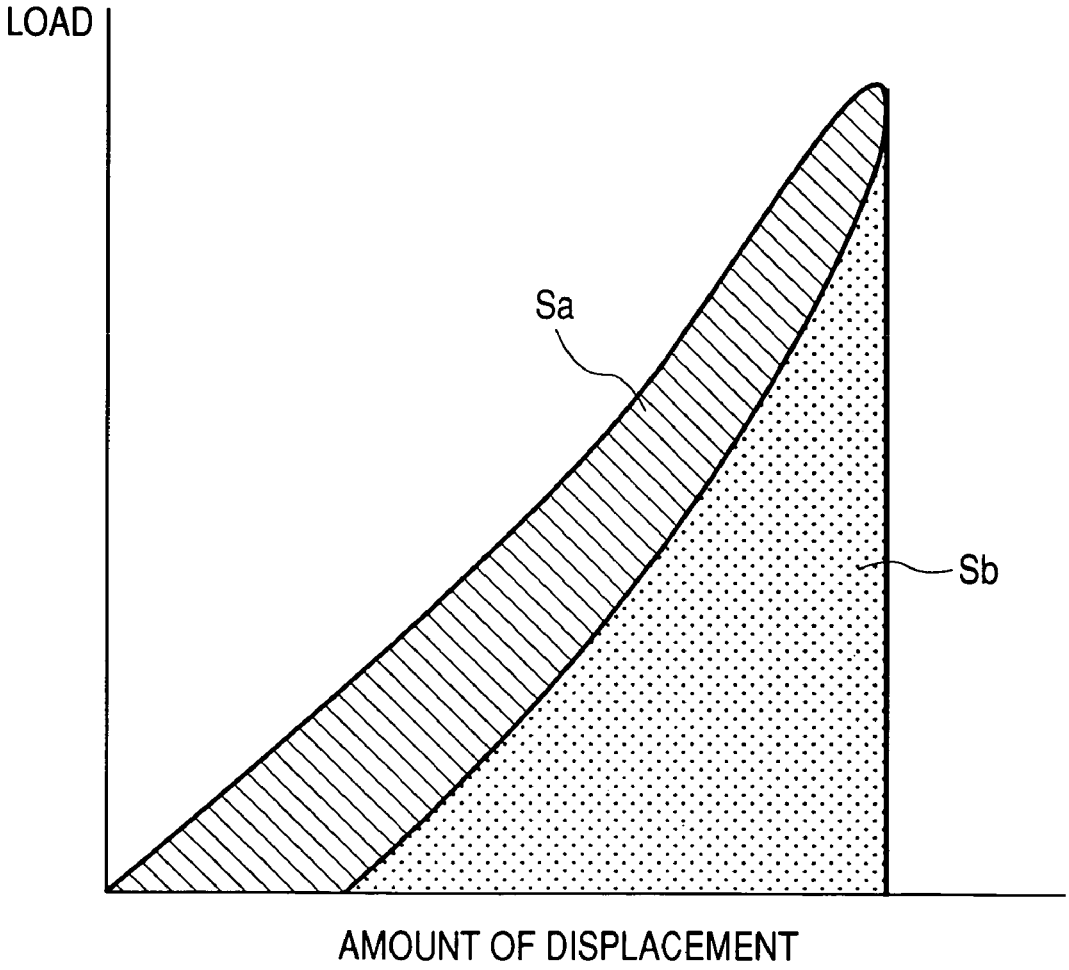
FIG. 4 shows the result of the measurement of surface microhardness when an elastic energy component percentage is to be found.

The surface resistivity of the coat surface of the intermediate transfer belt 51 of a two-layer construction after spray-coated was measured to be $1\times10^9$-$10^{14}$ Ω/□. Further, the percentage of an elastic energy component to entire energy (plastic energy component+elastic energy component) found from the relation between the load and the amount of displacement measured by a supermicro indentation hardness test ENT1100 (produced by Elionix Co., Ltd.) was 50 to 80%. As the measuring method, use is made of an indenter of 100 μm×100 μm square, and it is pushed in up to a maximum load of 10 mgf, and the data of the relation between the load and the amount of displacement when the load is weakened thereafter is taken. The result is such a hysteresis curve as shown in FIG. 4. The plastic energy is represented by the area Sa of a portion indicated by hatching, and the elastic energy is represented by the area Sb of a portion indicated by dots. Accordingly, the respective areas Sa and Sb are found, and the elastic energy component percentage is found. A specific method of measuring the elastic energy component percentage will be described later in detail.

Also, in the present embodiment, semi-electrically conductive rollers are adopted as the primary transfer rollers 5*a* to 5*d*. Each of these primary transfer rollers 5*a* to 5*d* is constituted by a mandrel having a diameter of 8 mm, and an electrically conductive urethane sponge layer covering the outer peripheral surface of this mandrel and having a thickness of 4 mm. The hardness of these primary transfer rollers 5*a* to 5*d* is 25 to 40° in terms of Asker C hardness, and the resistance value thereof was found from the relation of an electric current measured with the primary transfer rollers 5*a* to 5*d* rotated at a peripheral speed of 20 mm/sec. relative to the ground under a load of 500 gram-weight on each of the opposite ends of the mandrel, and a voltage of 50 V applied to the mandrel, and was about $10^6$ Ω (a temperature of 23° C. and humidity of 50%). Also, the pressure in each primary transfer portion T1 can stably form a nip, and can be $1\times10^2$ Pa or greater. In the present embodiment, it was set to the order of $1\times10^4$ Pa.

Figure 5:
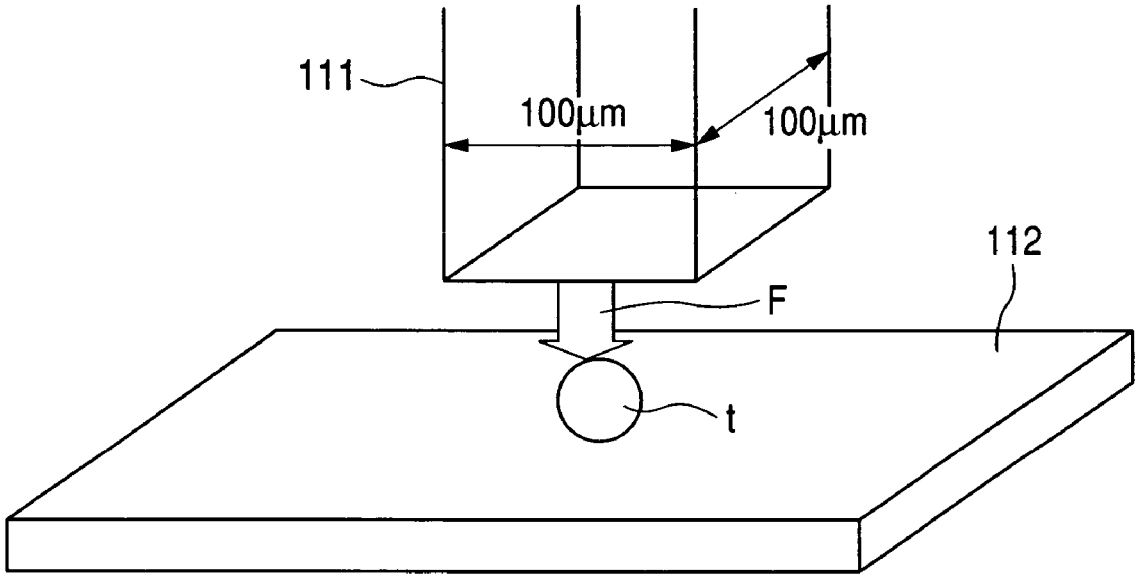
FIG. 5 is a perspective view illustrating the manner in which the surface microhardness is measured.

Reference is now had to FIG. 5 to describe a method of measuring the magnitude relationship between the surface microhardness of the toner and the surface microhardness of the intermediate transfer belt 51. The measurement is effected by a supermicro indentation hardness test ENT1100 (produced by Elionix Co., Ltd.).

As shown in FIG. 5, a particle of toner "t" is placed on a metal table 112 as a sample bed.

When the toner used is a host particle of toner having an extraneous additive mixed therewith, the toner "t" placed on the metal table 112 may be a host particle of toner having an additive adhering thereto.

A square shape having a horizontal cross section of 100 μm×100 μm is selected as the size of an indenter 111. The maximum indentation load is set to 10 mgf, and the indenter 111 is lowered. Measurement was effected for a holding time of 10 msec. and with the number of steps up to the maximum load divided into 250. The relation between the load applied to the then indenter 111 and the amount of displacement was found. Further, after the maximum load of 10 mgf has been reached, the load is likewise weakened at the same step intervals, and a hysteresis curve during an increase in the load and during a decrease in the load is prepared.

Next, a polyimide belt (not shown) and the above-described intermediate transfer belt 51 of a two-layer construction adopted in the present embodiment are placed on the metal table 111.

Then, the toner "t" was likewise placed on the polyimide belt and the intermediate transfer belt 51, and the relation between the load applied to the indenter 111 and the amount of displacement was likewise found.

Figure 6:
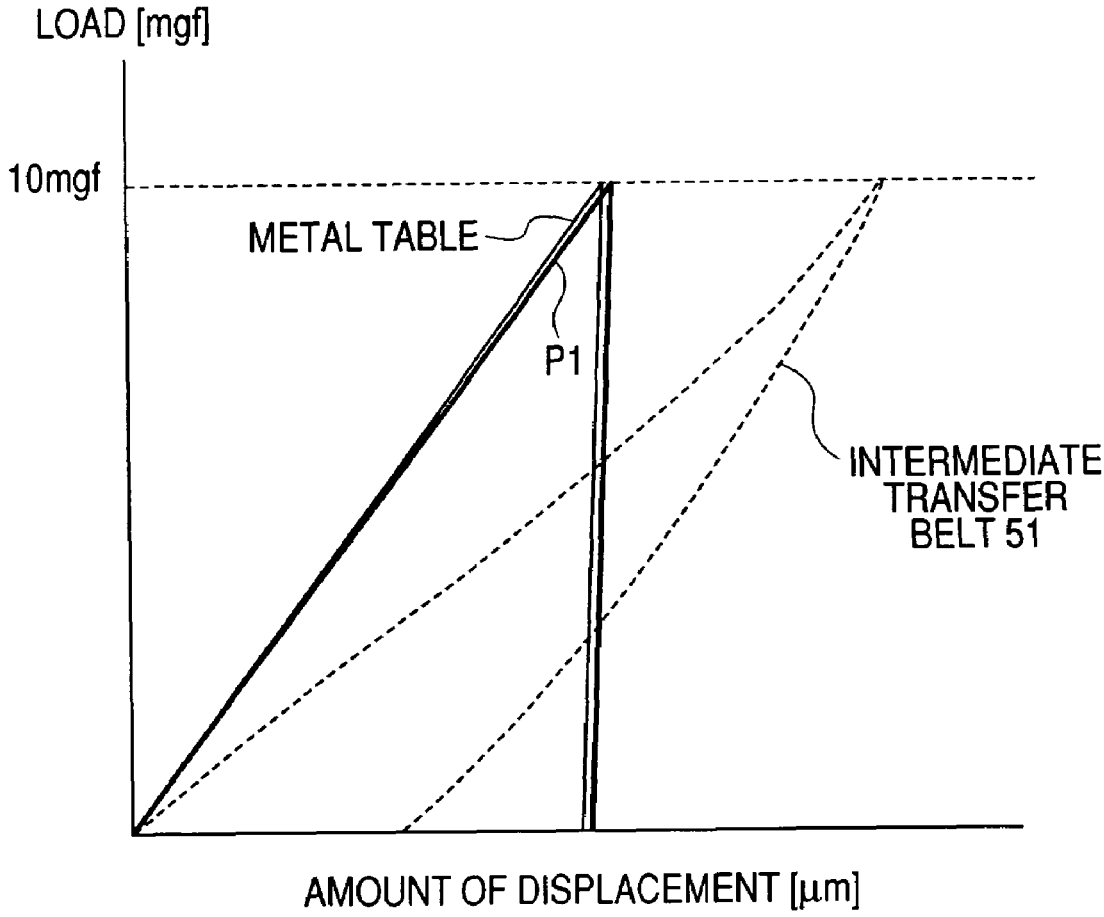
FIG. 6 illustrates a technique of finding out the relation between the surface microhardness of a toner and the surface microhardness of the belt.

The result of these is shown in FIG. 6. In FIG. 6, a thin solid line indicates the metal table, a thick solid line indicates the polyimide belt (PI), and a dotted line indicates the intermediate transfer belt 51 used in the present embodiment. It will be seen from FIG. 6 that the metal table and polyimide are higher in hardness than the toner "t" and therefore, the amount of displacement thereof does not change even when the load is weakened. That is, when a load of 10 mgf is applied, the toner "t" is almost plastically deformed. In contrast, the intermediate transfer belt 51 used in the present embodiment is very small in the amount of plastic deformation and the apparent toner hardness looks lowered. That is, in the intermediate transfer belt 51 used in the present embodiment, it can be said that the relation that surface microhardness of toner>surface microhardness of belt materializes.

If the surface microhardness of toner>the surface microhardness of belt, the toner enters the belt and therefore, the apparent surface microhardness of the toner is lowered.

If, for example, as in the case of the above-described polyimide belt (PI), surface microhardness of toner≦surface microhardness of belt, the toner cannot enter the belt and therefore, the apparent microhardness of the toner is not changed.

In this manner, the magnitude relationship between the surface microhardness of the toner and the surface microhardness of the belt is confirmed.

If surface microhardness of toner>surface microhardness of belt, the condensation of the toner in the primary transfer portion T1 is greatly alleviated and therefore, a "hollow character" image hardly occurs.

However, it has been found in the study leading to the present invention that there is a case where the "scattering" is aggravated as a new problem when the relation that surface microhardness of toner>surface microhardness of belt is satisfied.

So, from the layer shape of the toner on an intermediate transfer member such as an intermediate transfer belt or an intermediate transfer drum, as a factor by which the "scattering" is aggravated, attention has been particularly paid to the "adhering force" among the physical property values of the toner. Then, it has come to be found that the "scattering" image of the toner transferred onto the intermediate transfer member depends on the "adhesive force" of the toner. Particularly, when the relation that the surface microhardness of toner>the surface microhardness of belt materializes, the formation of toner images on the intermediate transfer member becomes such as shown in the aforedescribed FIG. 7C and therefore, the upper layer toner becomes unstable. Thereupon, the upper layer toner is collapsed in the directions indicated by the arrows in FIG. 7C and the scattering is aggravated.

In the present embodiment, the kind of the carrier as a magnetic material for charging the toner, the ratio of the toner and the carrier and further, the extraneous additive or the like were adjusted to thereby make the charge density of the toner into 20 to 40 μC/g under an environment of temperature 23° C. and humidity 50%.

Here, the host particles of the toner are constituted by polyester resin. Also, the host particles of the toner are formed into a weight mean average diameter of the order of 3 to 11 μm.

Further, in order to adjust the fluidity and adhering force of the toner, 0.3 to 5.0 parts by weight of inorganic powder constituted by silica, alumina, titanium oxide or the like was extraneously added to 100 parts by mass of host particles of the toner.

Figure 8:
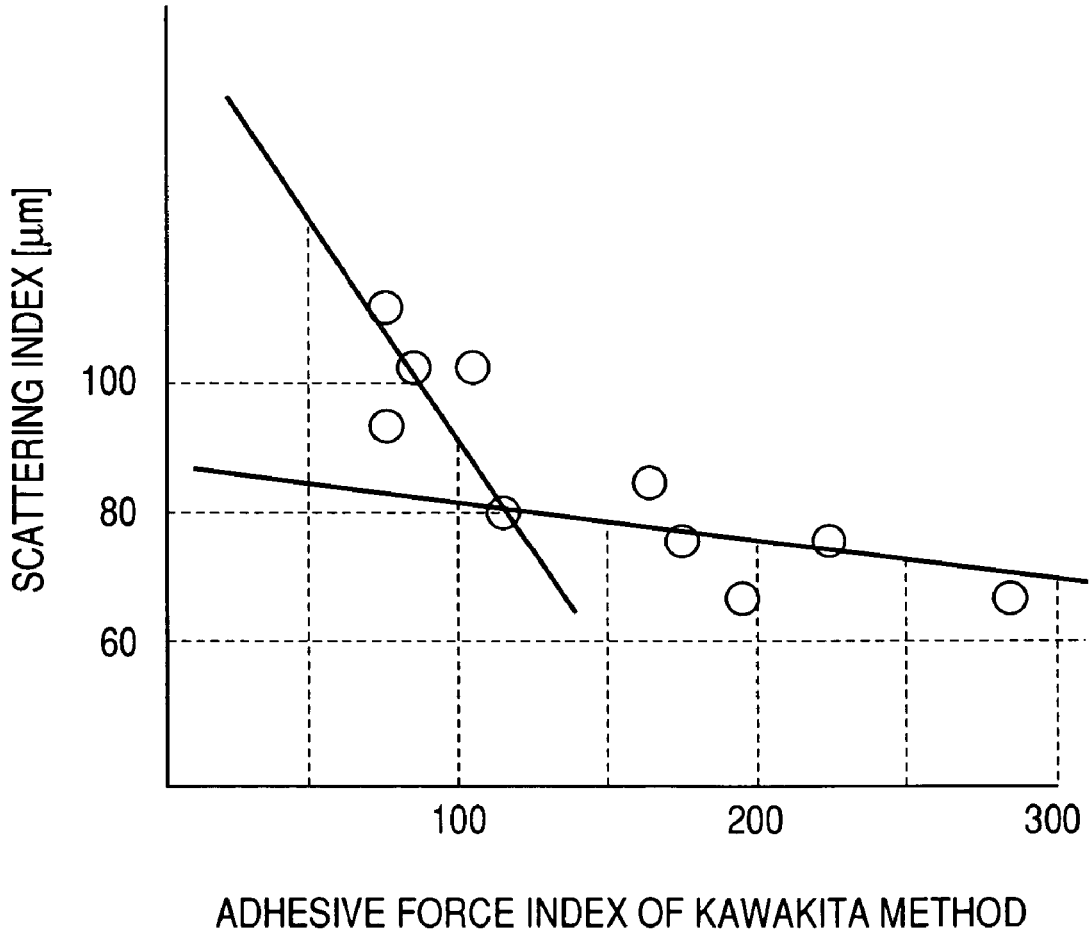
FIG. 8 illustrates the relation between the adhesive force index of Kawakita method and scattering index.

FIG. 8 represents the relation between the "adhesive force index of Kawakita method" as an index representative of the adhesive force of the toner and a blur value (scattering index defined by ISO 13660) as an index representative of the quality of image. It will be seen from FIG. 8 that the blur value tends to be suddenly aggravated when the "adhesive force index of Kawakita method" becomes smaller than 110.

The scattering index referred to here is a value measured by a personal image analysis system (IAS) produced by Quality Engineering Associates (QEA) Co., Ltd., and refers to a blur value (a numerical value representative of the way of blurring of a line defined by ISO 13660).

From the foregoing, it has been found that a belt having surface microhardness smaller than the surface microhardness of the toner is adopted as the intermediate transfer belt, and the "adhesive force index of Kawakita method" of the toner is made into 110 or greater, whereby there can be obtained a good quality of image which is small in the collapse and "scattering" of the toner image.

Figure 9:
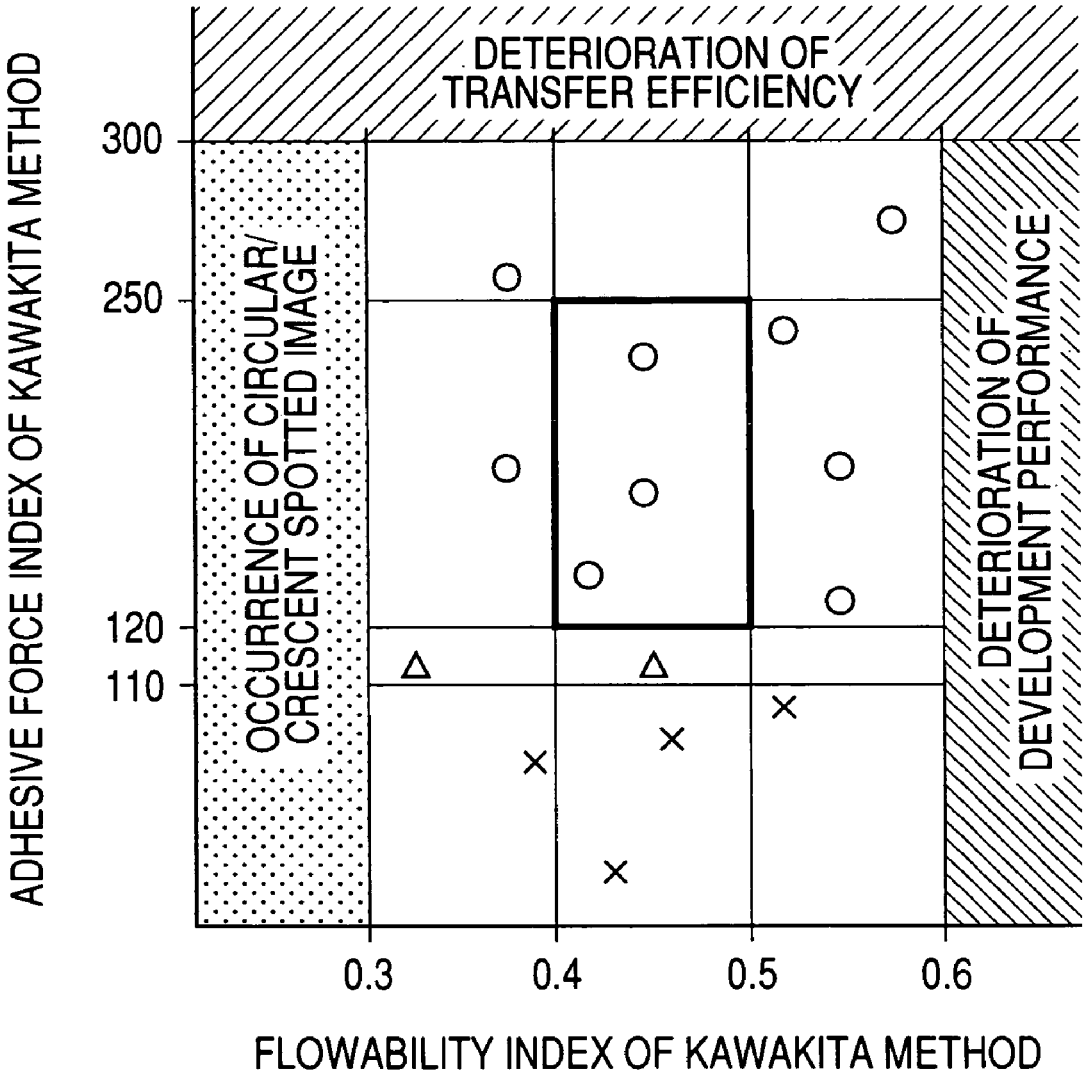
FIG. 9 illustrates the relations among the flowability index of Kawakita method and the adhesive force index of Kawakita method and a developing characteristic, a transfer characteristic and an image characteristic.

Next, as shown in FIG. 9, the "flowability index of Kawakita method" was plotted as the x-axis (the axis of abscissas) and the "adhesive force index of Kawakita method" was plotted as the y-axis (the axis of ordinates), and studies were effected about a transfer characteristic, a development characteristic and other image property than scattering.

When the "flowability index of Kawakita method" exceeded 0.6, the development characteristic was aggravated and the quality ("coarseness") of halftone image was aggravated. When the "flowability index of Kawakita method" becomes below 0.3, the toner image becomes liable to move and the image fault that charges jump into the image formed on the intermediate transfer belt becomes liable to occur. Particularly in a low-humidity environment (in the present embodiment, an environment of temperature 23° C. and humidity 5%), a discharge image scattering in a circular/crescent spotted shape occurred, or a bird's-leg-shaped discharge image occurred. From the foregoing, it is preferable to refer also to the "flowability index of Kawakita method" and set this "flowability index of Kawakita method" to 0.30 to 0.60, and more preferably to 0.40 to 0.50.

Further, when the "adhesive force index of Kawakita method" exceeds 300, the transfer efficiency lowers. This is because when even a small amount of untransferred toner exists on the photosensitive drum, a toner adhering to that toner also becomes liable to remain on the photosensitive drum and as a whole, the transfer efficiency lowers. This can also be said about the case of the transfer efficiency in the secondary transfer and thus, the entire transfer utilization rate lowers greatly. Accordingly, it is preferable to set the "adhesive force index of Kawakita method" to 300 or less. On the other hand, in the case of 110 or less, scattering occurs to the toner image. Accordingly, it is preferable to set the "adhesive force index of Kawakita method" to 110 to 300, and more preferably to 120 to 250.

The above-described "flowability index of Kawakita method" and "adhesive force index of Kawakita method" can be adjusted by allotting several parameters thereto (varying) in effecting toner designs such as, for example, the volume mean particle diameter of the toner, the shape of the toner, the amount of extraneous additive to the toner, and the amount of wax contained in the toner.

From what has been described above, in an image forming apparatus adopting an intermediate transfer belt in which the relation that surface microhardness of toner>surface microhardness of belt materializes, and effecting primary transfer under pressure of $1\times10^2$ Pa or greater, it is possible to achieve a high quality of image by setting the "adhesive force index of Kawakita method" of the toner to 110 or greater. It is more preferable that the "flowability index of Kawakita method" be 0.30 to 0.60, and further the "adhesive force index of Kawakita method" be 300 or less.

Still more preferably, the "flowability index of Kawakita method" may be 0.4 to 0.5, and the "adhesive force index of Kawakita method" may be 120 to 250.

Description will now be made of a method of obtaining the "flowability index of Kawakita method (flowability index)" and the "adhesive force index of Kawakita method" shown in the present embodiment (see Materials, Vol. 14, pp. 144 and 702 to 712 (1965), published by Powder Material Measuring Technique Center for details).

Figure 10:
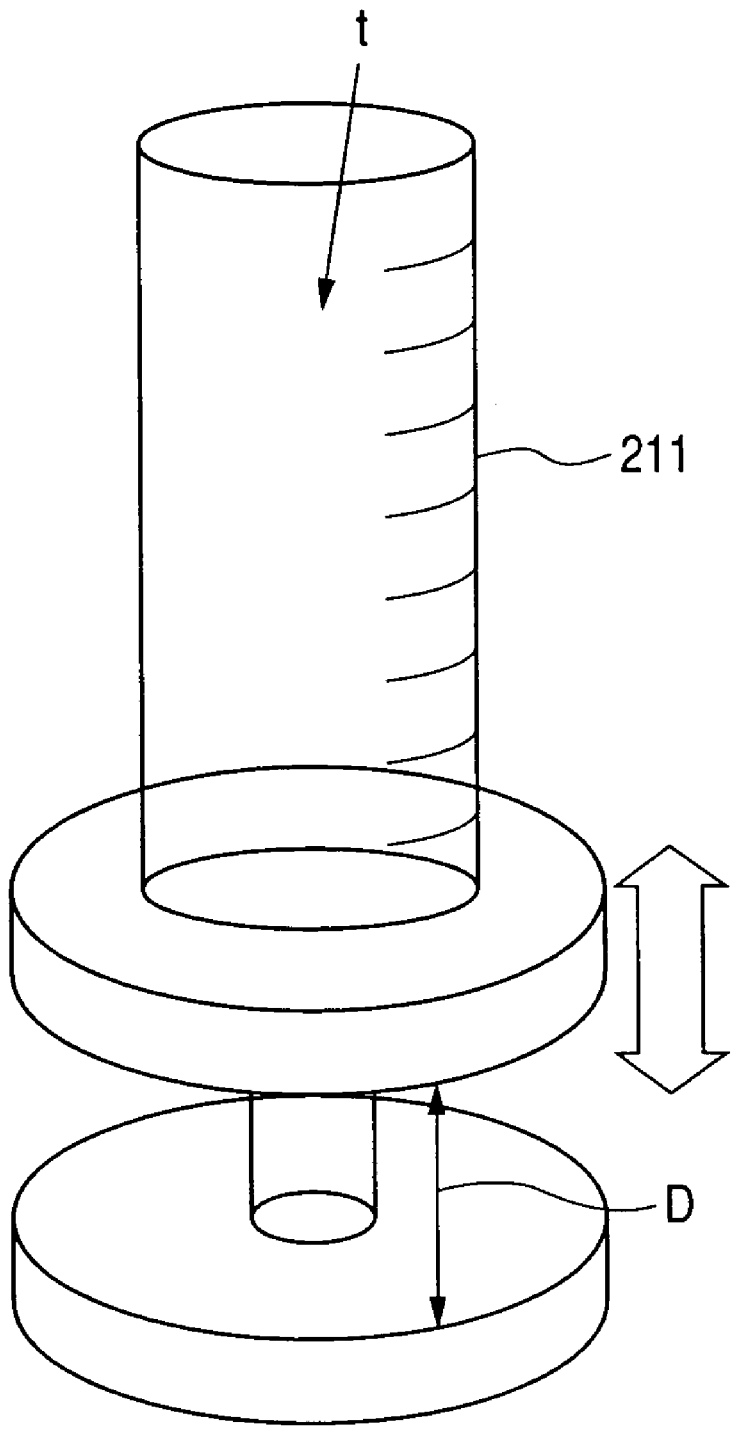
FIG. 10 illustrates a method of measuring the flowability index of Kawakita method and the adhesive force index of Kawakita method.

As shown in FIG. 10, as the apparatus, use is made of a powder material density measuring machine TAP DENSER (KYT-3000). A tapping cell of 100 cc is adopted as a tapping cell 211. A stroke (fall) D by which the tapping cell is made to fall is set to 50 mm, and the tapping cell is mounted on the apparatus. As the toner, a toner left under an environment of temperature 23° C. and humidity 50% for 24 hours or longer was adopted. The toner "t" is poured into the tapping cell 211. Preparations are completed when the tapping cell 211 of 100 cc has become full.

Subsequently, the tapping of the tapping cell 211 is started. As regards the measurement of the volume of the toner, measurement was effected 13 times in total, that is, 5 times for each 20 times up to 100 times of tapping, 4 times for each 50 times up to 300 times of tapping beyond 100 times, 2 times for each 100 times up to 500 times of tapping beyond 300 times, and 2 times for each 250 times up to 1,000 times of tapping beyond 500 times.

After the termination of 1,000 times of tapping, the total weight of the tapping cell 211 and the toner is measured, and further the weight of the tapping cell after the washing of the toner is measured.

From the above-described measurement data, the number of tappings N, the volume Vt of the powder material in a cylinder during the number of tappings T, the initial volume V0 (100 cc in this embodiment), the volume reduction degree C=(V0−Vt)/V0, the initial density ρ0 and the final tap density ρ are found.

Figure 11:
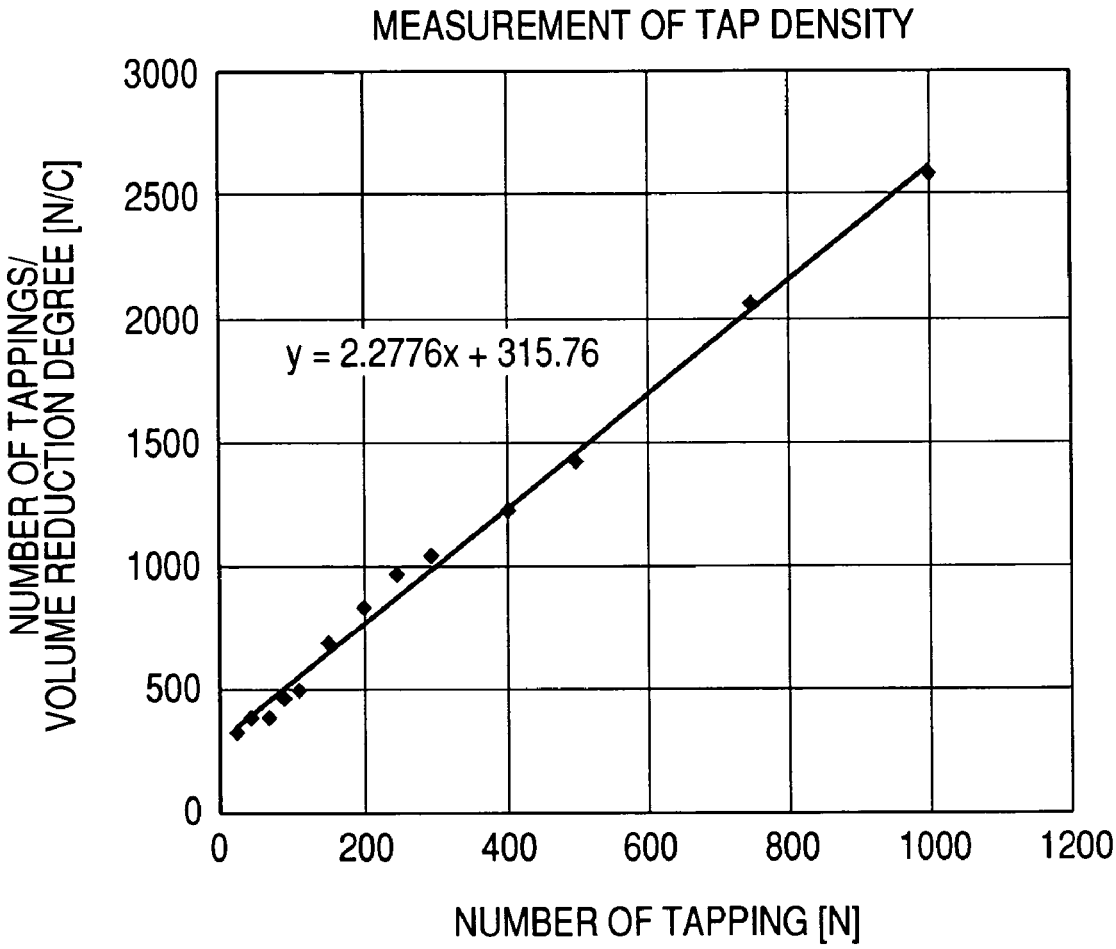
FIG. 11 illustrates a method of finding the flowability index of Kawakita method and the adhesive force index of Kawakita method.

The analysis expression of Kawakita method is as follows:

$$N/C=(1/a)\times N+1/(a\times b)$$

and therefore, there is prepared such a graph that in a two-dimensional space, N is plotted as the x-axis and N/C is plotted as the y-axis, and (1/a) is the inclination and 1/(a×b) is a y-intercept. The result of this is shown in FIG. 11. From FIG. 11, an approximate straight line (a linear expression) is found, and from the inclination thereof, the "flowability index of Kawakita method" represented by the inverse number thereof can be found.

Also, the inverse number of the y-intercept is represented by the product of the "flowability index of Kawakita method" and the "adhesive force index of Kawakita method" and therefore, by multiplying the y-intercept by the "flowability index of Kawakita method", it is possible to find the "adhesive force index of Kawakita method".

Embodiment 2

This embodiment differs in the construction of the intermediate transfer belt 51 from the above-described Embodiment 1. That is, in this embodiment, a base layer is further added to the above-described intermediate transfer belt 51.

Figure 12:
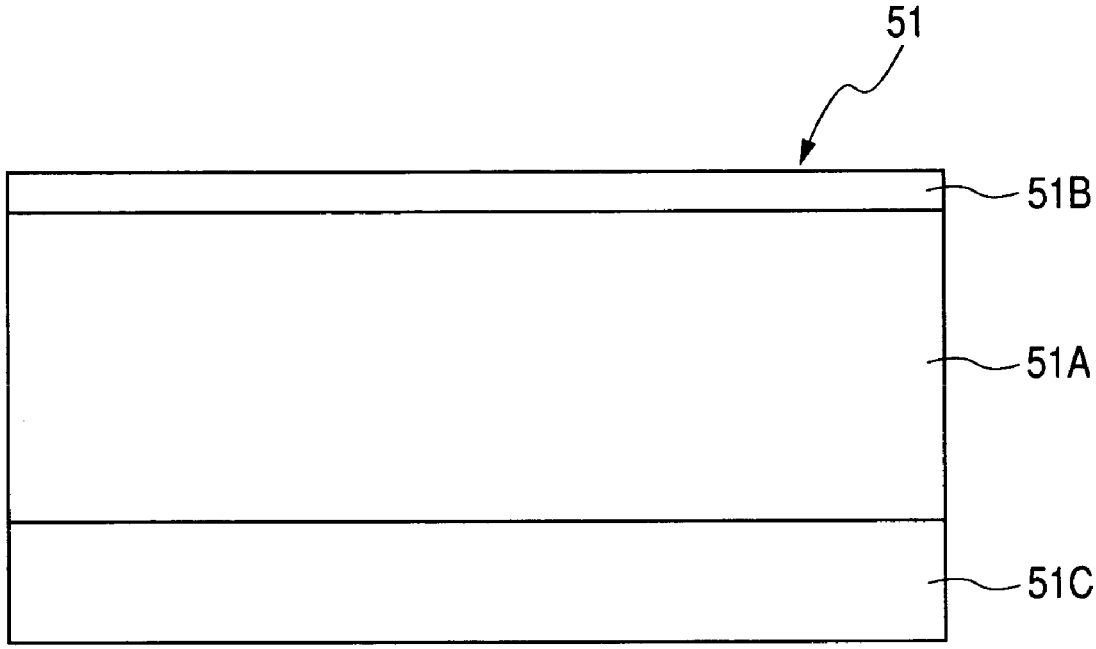
FIG. 12 typically shows the layer construction of an intermediate transfer belt in Embodiment 2.

FIG. 12 shows the intermediate transfer belt 51 used in the present embodiment. As shown in FIG. 12, the intermediate transfer belt 51 is of three-layer structure having a base layer 51C, an elastic layer 51A and a surface layer 51B from the back side toward the front side thereof.

The base layer 51C should preferably be formed of resin having mechanical strength of Young's modulus 1 to 6 GPa, and in the present embodiment, use is made of a semi-electrically conductive polyimide belt having a film thickness of 75 to 95 μm, a tensile elasticity modulus of 2-4 GPa, volume resistivity of $1\times10^8$-$1\times10^{12}$ Ω·cm, and surface resistivity of $1\times10^9$-$1\times10^{14}$ Ω/□.

The measurement of the tensile elasticity modulus was effected by measuring a sample cut into a dumbbell No. 1 type shape prescribed by JIS K 6251, by ORIENTEC STA-1225 Tensilon tension test machine. The head speed in the measurement was 500 mm/min.

Also, for the measurement of the volume resistivity and the surface resistivity, there was adopted an electrode conforming to JIS K 6911 (main electrode outer diameter 50 mm, guard electrode inner diameter 70 mm, guard electrode outer diameter 80 mm, and weight 1400±100 g), and as a resistance measuring machine, use was made of a digital super-high resistance/microammeter R8340A (produced by Advantest Co., Ltd.), and it is to be understood that the value is measured after 10 seconds from the time the applied voltage 100 V is applied.

As the elastic layer 51A, one similar to that in Embodiment 1 is adopted. Specifically, semi-electrically conductive chloroprene rubber having JISA hardness 50 to 70°, a film thickness of 200 to 500 μm, a tensile elasticity modulus of $1\times10^5$-$1\times10^7$ Pa (JIS K 7161), a compressive elasticity modulus of $1\times10^6$-$1\times10^8$ Pa (JIS K 7181) and volume resistivity of $1\times10^8$-$1\times10^{12}$ Ω·cm (a measuring method similar to that described above).

Also as the surface layer 51B, one similar to that in Embodiment 1 is adopted. Specifically, this layer was formed by spray coating with Daiel (trademark) latex GLS-213F produced by Daikin Industries, Ltd. as a water-based paint. The surface of the elastic layer 51A was spray-coated, and thereafter was hardened at 150 to 200° C. for 30 minutes, to thereby form a surface layer 51B having a thickness of 5 to 20 μm. As the result, the surface had a coefficient of static friction of 0.2 to 0.6 and surface roughness of 1 to 5 μm.

The surface resistivity of the coat surface of the intermediate transfer belt 51 of a three-layer construction after spray-coated was measured to be $1\times10^9$-$1\times10^{14}$ Ω/□. Further, the percentage of an elastic energy component to entire energy (a plastic energy component+an elastic energy component) found from the relation between the load and the amount of displacement measured by a micro indentation hardness test ENT1100 (produced by Elionix Co., Ltd.) was 50 to 80%.

As described above, the intermediate transfer belt 51 having the base layer 51C can also obtain an effect similar to that of Embodiment 1. The presence of the base layer 51C can prevent the expansion and contraction of the belt, and is effective for the scattering of the toner attributable to the expansion and contraction of the belt occurring when the intermediate transfer belt 51 passes the rollers (e.g., the driven roller 55A, the drive roller 55B and the secondary transfer opposed roller 55C) around which the intermediate transfer belt 51 is stretched, and can achieve a higher quality of image.

Embodiment 3

Figure 13:
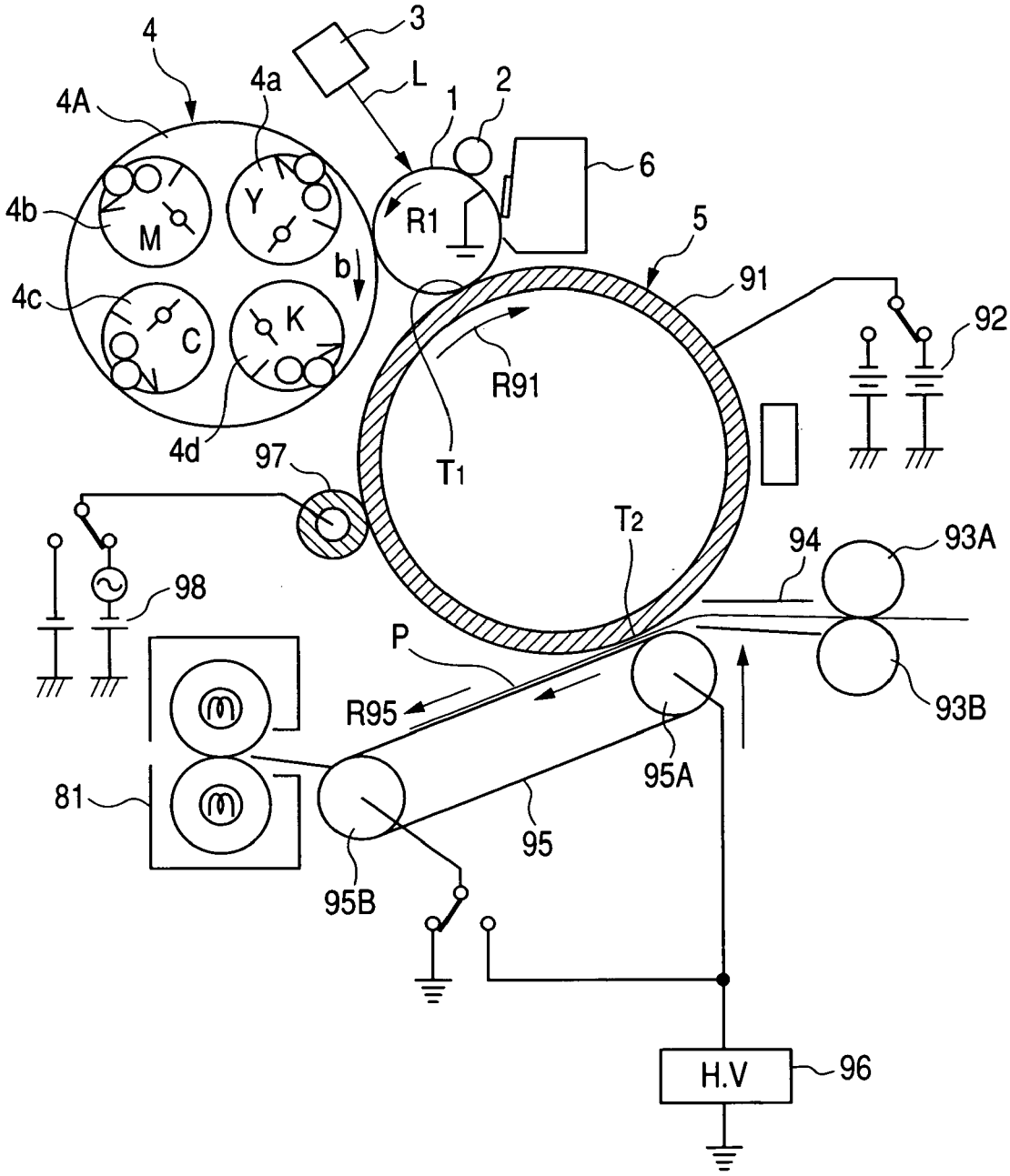
FIG. 13 is a longitudinal cross-sectional view schematically showing the construction of an image forming apparatus according to Embodiment 3 as it is seen from its front side.

FIG. 13 shows an image forming apparatus according to this embodiment. The image forming apparatus shown in FIG. 13 is a four-color full-color image forming apparatus, and FIG. 13 is a longitudinal cross-sectional view schematically showing the construction thereof.

The image forming apparatus shown in FIG. 13 is provided with a drum-shaped electrophotographic photosensitive member (hereinafter referred to as the "photosensitive drum") 1 as an image bearing member, a primary charging roller (charging device) 2 as charging means, an exposing device 3 as exposing means, a developing device 4 as developing means, a transferring device 5 as transferring means, a cleaning device 6 as cleaning means, and a fixing device 81 as fixing means. It is also provided with an intermediate transfer belt 91 as an intermediate transfer member, and a transfer belt 95 for conveying a recording material S.

The photosensitive drum 1 is rotatively driven at a predetermined process speed (peripheral speed) in the direction indicated by the arrow R1, and is uniformly charged to a predetermined polarity and predetermined potential in the rotational process thereof by the primary charging roller 2. The charged photosensitive drum 1 is subjected to image exposure L by the exposing device (e.g. a color separation and imaging optical system for a color original image, a scanning-exposing optical system by a laser scanner outputting a laser beam modulated according to the time-series electrical digital pixel signal of image information, etc.) 3, whereby an electrostatic latent image corresponding to a first color component (e.g. a yellow component image) of a desired color image is formed thereon.

This electrostatic latent image is developed with a yellow toner, which is a first color, by the developing device (first developing device) 4*a* of the developing apparatus 4. The developing apparatus 4 is provided with the yellow (Y) developing device 4*a*, a magenta (M) developing device (second developing device) 4*b*, a cyan (C) developing device (third developing device) 4*c* and a black (K) developing device (fourth developing device) 4*d*. These developing devices 4*a* to 4*d* are carried on a rotatable rotary 4A, and by the rotation of the rotary 4A in the direction indicated by the arrow "b", a developing device to be used for development is disposed at a developing position opposed to the photosensitive drum 1.

The transferring device 5 has an intermediate transfer drum 91 as an intermediate transfer member for effecting primary transfer, and a transfer belt (transfer member) 95 for effecting secondary transfer. The intermediate transfer drum 91 is rotatively driven at the same peripheral speed as that of the photosensitive drum 1 in the direction indicated by the arrow R91. In the present embodiment, a drum-shaped intermediate transfer member 91 is used as the intermediate transfer member.

A first color, i.e. yellow toner image formed on the photosensitive drum 1 is primary-transferred (intermediately transferred) to the outer peripheral surface of the intermediate transfer drum 91 by an electric field formed by a primary transfer bias applied to the intermediate transfer drum 91 by a pressure and a primary transfer bias applying voltage source 92 in the process of passing through a primary transfer portion (primary transfer nip portion) T1 between the photosensitive drum 1 and the intermediate transfer drum 91.

Thereafter, a second color, i.e., magenta toner image, a third color, i.e., cyan toner image and a fourth color, i.e., black toner image formed on the photosensitive drum 1 in a similar manner by the magenta developing device 4*b*, the cyan developing device 4*c* and the black developing device 4*d*, respectively, are successively superposed and transferred onto the intermediate transfer drum 91.

The primary transfer bias applied from the primary transfer bias applying voltage source 92 in case of the primary transfer of the above-described toner images of the first to fourth colors is of a polarity (plus) opposite to the polarity of the toners. In the successive transferring steps of the toner images of the first to fourth colors from the photosensitive drum 1 to the intermediate transfer drum 91, the transfer belt 95 and an intermediate transfer member cleaning roller 97 are spaced apart from the intermediate transfer drum 91.

The transfer belt 95 is supported in parallelism to the intermediate transfer drum 91 by bearings and is installed below the intermediate transfer drum 91 for movement toward and away from the latter. The transfer belt 95 is passed over a secondary transfer roller 95A and a drive roller 95B, and is rotated in the direction indicated by the arrow R95. A desired secondary transfer bias is applied to the secondary transfer roller 95A by a secondary transfer bias applying voltage source 96 to thereby bring also the drive roller 95B into equal potential. The transfer belt 95 is brought into contact with the intermediate transfer drum 91 to thereby constitute a secondary transfer portion (secondary transfer nip portion) T2. On the other hand, a recording material P is fed from a sheet supplying cassette (not shown) to the secondary transfer portion T2 past registration rollers 93A and 93B and an ante-transfer guide 94 at predetermined timing. At this time, a secondary transfer bias is applied from the secondary transfer bias applying voltage source 96 to the secondary transfer roller 95A, and the toner images of the four colors on the intermediate transfer drum 91 are collectively secondary-transferred onto the recording material P. The recording material P to which the toner images have been transferred is conveyed to a fixing device 81, where it is heated and pressurized, whereby the toner images on the surface of the recording material are fused and fixed. On the other hand, toners not secondary-transferred to the recording material P but residual on the intermediate transfer drum 91 (secondary transfer residual toners) are turned to a polarity (plus) opposite to the normal polarity by the intermediate transfer member cleaning roller 97 to which a bias having a DC voltage superimposed thereon has been applied from a voltage source 98, and are electrostatically attracted to the photosensitive drum 1 thereby through the primary transfer portion T1, and the surface of the intermediate transfer drum 91 is cleaned. The secondary transfer residual toners thus attracted onto the photosensitive drum 1 are thereafter removed and collected by the cleaning device 6 for the photosensitive drum 1.

Figure 14:
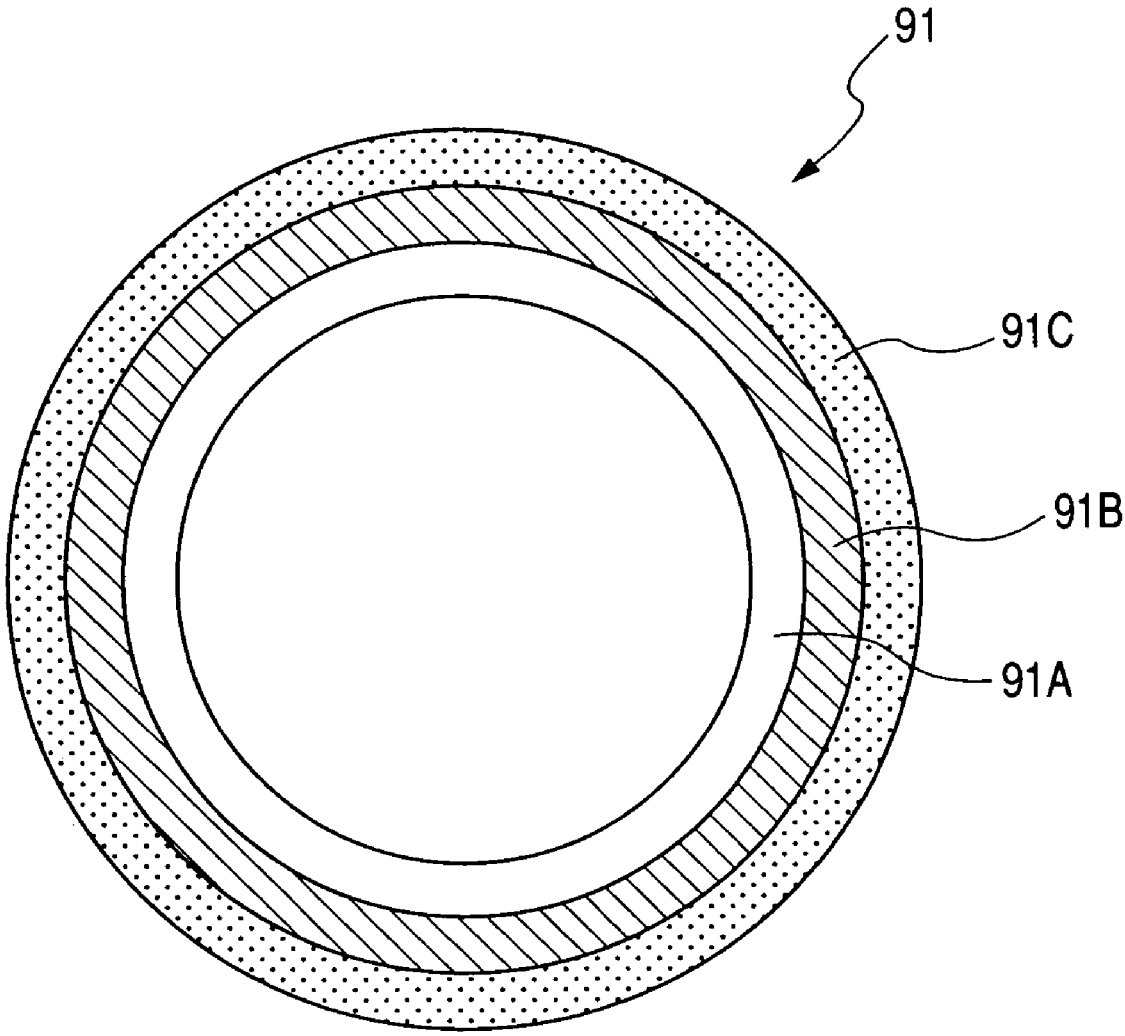
FIG. 14 typically shows the layer construction of an intermediate transfer drum in Embodiment 3.

In the image forming apparatus according to the present embodiment, the intermediate transfer drum 91, as shown in FIG. 14, comprises a cylindrical mandrel 91A of aluminum having a thickness of 3 mm, an elastic layer 91B of 450 μm provided thereon, and a surface layer (mold releasing layer) 91C of 15 μm further formed on the elastic layer 91B. As the materials of the elastic layer 91B and the surface layer 91C, use is made of materials similar to those in the afore-described Embodiments 1 and 2, and the outer diameter of the intermediate transfer drum 91 is 186 mm in total.

Also, it is similar to the above-described embodiments that the use of toners of which the "adhesive force index of Kawakita method" is 110 or greater leads to the obtainment of a high quality of image. It is also similar that the adoption of toners of which the "flowability index of Kawakita method" is 0.3 or greater and 0.6 or less and the "adhesive force index of Kawakita method" is 110 or greater and 300 or less is more preferable.

Further, by using the intermediate transfer drum 91 of the drum construction as the intermediate transfer member, the curvature of the surface of the intermediate transfer member is relatively constant as compared with the belt construction, and this leads to the advantage that the thickness of the elastic layer 91B can be designed relatively freely relative to the surface speed of the intermediate transfer member. Also, the localized expansion and contraction of the elastic layer 91B can be substantially neglected and therefore, a high quality of image could be realized.

This application claims priority from Japanese Patent Application No. 2004-306260 filed Oct. 20, 2004, which is hereby incorporated by reference herein.

What is claimed is:

1. An image forming apparatus comprising:

an image bearing member, which bears an electrostatic image thereon;

developing means for developing the electrostatic image with toner to form a toner image; and an intermediate transfer member, which is in contact with said image bearing member and to which the toner image formed on said image bearing member is transferred, wherein a surface microhardness of said intermediate transfer member is smaller than a surface microhardness of the toner, and an adhesive force index of Kawakita method of the toner is 110 or greater.

2. An image forming apparatus according to claim 1, wherein the adhesive force index of Kawakita method of the toner is 300 or less.

3. An image forming apparatus according to claim 2, wherein a flowability index of Kawakita method of the toner is 0.3 or greater and 0.6 or less.

4. An image forming method comprising:

forming an electrostatic image on an image bearing member;

developing the electrostatic image with toner to form a toner image; and transferring the toner image to an intermediate transfer member being in contact with the image bearing member, wherein a surface microhardness of the intermediate transfer member is smaller than a surface microhardness of the toner, and an adhesive force index of Kawakita method of the toner is 110 or greater.

5. An image forming method according to claim 4, wherein the adhesive force index of Kawakita method of the toner is 300 or less.

6. An image forming method according to claim 5, wherein a flowability index of Kawakita method of the toner is 0.3 or greater and 0.6 or less.

* * * * *